US009210986B2

(12) United States Patent
Tranchant et al.

(10) Patent No.: US 9,210,986 B2
(45) Date of Patent: Dec. 15, 2015

(54) COSMETIC APPLICATOR DEVICE AND THE USE OF SUCH A DEVICE

(75) Inventors: Jean-Francois Tranchant, Marigny-les-Usages (FR); Marc Chevalier, Franconville (FR)

(73) Assignee: L V M H RECHERCHE, Saint Jean de Braye (FR)

( * ) Notice: Subject to any disclaimer, the term of this patent is extended or adjusted under 35 U.S.C. 154(b) by 841 days.

(21) Appl. No.: 13/034,381

(22) Filed: Feb. 24, 2011

(65) Prior Publication Data

US 2012/0163897 A1 Jun. 28, 2012

(30) Foreign Application Priority Data

Dec. 27, 2010 (FR) ..... 10 61272

(51) Int. Cl.
*A45D 34/04* (2006.01)

(52) U.S. Cl.
CPC ..... *A45D 34/045* (2013.01); *A45D 2200/056* (2013.01)

(58) Field of Classification Search
CPC ..... A45D 34/045
USPC ..... 401/118, 119, 183, 187, 188 R, 190, 268
See application file for complete search history.

(56) References Cited

U.S. PATENT DOCUMENTS

| | | | | |
|---|---|---|---|---|
| 1,635,176 | A * | 7/1927 | Dorment | 401/185 |
| 2,791,789 | A | 5/1957 | Smith et al. | |
| 3,734,106 | A * | 5/1973 | Zimmerman | 401/183 |
| 4,804,004 | A | 2/1989 | Taylor | |
| 6,719,471 | B1 * | 4/2004 | Giro | 401/188 R |
| 8,079,771 | B2 * | 12/2011 | Ko | 401/188 R |
| 2005/0238408 | A1 | 10/2005 | Ramet | |

FOREIGN PATENT DOCUMENTS

DE 3618046 12/1987

OTHER PUBLICATIONS

Search report from counterpart French Application No. FR 106272; Report dated Dec. 27, 2010.

* cited by examiner

*Primary Examiner* — David Walczak
*Assistant Examiner* — Bradley Oliver
(74) *Attorney, Agent, or Firm* — Miller, Matthias & Hull LLP

(57) ABSTRACT

An applicator device for applying a cosmetic, the device comprising: a reservoir of cosmetic and an applicator including a stem that is terminated by an applicator head that is adapted to apply the cosmetic to a part of a user's body, the stem of the applicator including an internal duct that opens out sideways via a vent that is formed in the applicator head, the applicator including a gas generator that is connected to said duct and that is adapted to inject gas into the duct.

14 Claims, 3 Drawing Sheets

COSMETIC APPLICATOR DEVICE AND THE USE OF SUCH A DEVICE

CROSS-REFERENCE TO RELATED APPLICATIONS

This application claims priority under the Paris Convention to the French Patent Application No. 10 61272, filed on Dec. 27, 2010.

FIELD OF THE DISCLOSURE

The present invention relates to cosmetic applicator devices and to the use of such devices.

BACKGROUND OF THE DISCLOSURE

More particularly, the invention relates to an applicator device for applying a cosmetic, the device comprising:

- a reservoir that is adapted to contain a liquid cosmetic (that is viscous to a greater or lesser extent); and
- an applicator comprising a stem that is terminated by an applicator head that is adapted to apply the cosmetic to a part of a user's body (in particular for applying makeup to keratinous fibers, such as the eyelashes, the eyebrows, and the hair), said stem being adapted to penetrate into said reservoir so as to dip said applicator head into the cosmetic.

In known applicator devices of this type, the applicator head is a brush that enables the cosmetic to be applied exclusively by direct contact with the user's body.

SUMMARY OF THE DISCLOSURE

A particular object of the present invention is to improve applicator devices of this type, so as to provide a novel method of applying the cosmetic to the user's body that is almost instantaneous, with much more rapid drying, and requiring less contact, if any, between the applicator head and the user's body.

To this end, in the invention, in an applicator device of the type in question, the stem of the applicator includes an internal duct that opens out sideways via at least one vent that is formed in the applicator head, and the applicator further comprises a (permanent or removable) gas generator that is connected to said duct and that is adapted to inject gas into said duct so as to cause the gas to be expelled via said at least one vent.

By means of these provisions, the gas that is injected by the gas generator may form at least one bubble of cosmetic at the applicator head. The bubble of cosmetic may burst on coming into contact with the user's body, thereby enabling the cosmetic to be deposited almost instantaneously in a single step, without any contact between the applicator head and the user's body. In such conditions, the applicator head may possibly be used only to perfect the distribution of cosmetic that has already been applied to the user's body. Almost-instantaneous application of the cosmetic is thus made possible, and that is a first advantage compared to applicators devices of the prior art. In addition, repeated direct contact between the applicator head and the user's body is effectively limited. As a result of passing via a step consisting in forming a bubble, it is possible to create a thinner film, having a drying speed that is increased considerably. In practice, it is thus possible, in a single step, to deposit a continuous film having improved glossiness, and it is also possible to limit the cosmetic-transfer phenomena that are associated essentially with the sticky characteristic of the cosmetic during the drying period. In addition, during an application to the skin, the rapid-drying properties make it possible to obtain an immediate tightening effect, making it possible to smooth the surface of the skin so as to reduce the imperfections of its surface relief.

In various embodiments of the device of the invention, one or more of the following provisions may also be used:

- the gas generator is actuatable by the user and is designed to generate a (fixed or adjustable) predetermined volume of gas on each actuation;
- the gas generator includes an outlet valve that enables gas from the gas generator to be expelled towards the duct, but not the reverse.
- the gas generator is an air pump comprising a variable-volume air chamber that communicates with the duct via said outlet valve, and with the atmosphere via an inlet valve that enables air from the atmosphere to be let into the air chamber, but not the reverse;
- the gas generator comprises a flexible bulb that is adapted to be squeezed by the user and that defines said air chamber;
- the gas generator comprises a pusher that is actuatable by the user, that is adapted to compress the air chamber, and that is slidably mounted in a guide that forms part of the applicator;
- the pusher is adapted to bear against a flexible wall that defines the air chamber;
- the gas generator comprises an electric air compressor that is controlled by a control member that is actuatable by the user;
- the gas generator comprises a compressed-gas reservoir that is connected to the duct via a valve that is actuatable by the user;
- the applicator head includes a dish that opens outwards and that forms a reservoir for the cosmetic, said dish surrounding said at least one vent that opens out into said dish;
- the applicator head includes a plurality of vents and a plurality of dishes that open outwards and that form reservoirs for the cosmetic, each dish surrounding at least one of said vents;
- the applicator head further includes teeth;
- at least some of said teeth are disposed on either side of the dish;
- the applicator further includes a cap that is adapted to close the reservoir, the stem extending longitudinally from said cap as far as the applicator head, and being adapted to penetrate into the reservoir when the cap closes said reservoir, the gas generator being mounted on the cap (the gas generator may be fastened in permanent or removable manner, and it may either be incorporated in the cap, or may form an external part that is fitted on the cap);
- the reservoir contains a mascara that constitutes said liquid cosmetic.

In addition, the invention also provides the use of an applicator device as defined above for applying a cosmetic, in particular a mascara.

Finally, the invention provides a method of applying a cosmetic, said method comprising at least one step consisting in generating, by means of a device as defined above, at least one bubble of cosmetic, then in bursting said at least one bubble on coming into contact with a region of the body so as to apply said cosmetic to said region.

BRIEF DESCRIPTION OF THE DRAWINGS

Other characteristics and advantages of the invention appear from the following description of four embodiments, given by way of non-limiting example, and with reference to the accompanying drawings.

In the drawings.

DETAILED DESCRIPTION

In the various figures, the same references designate elements that are identical or similar.

Figure 1:
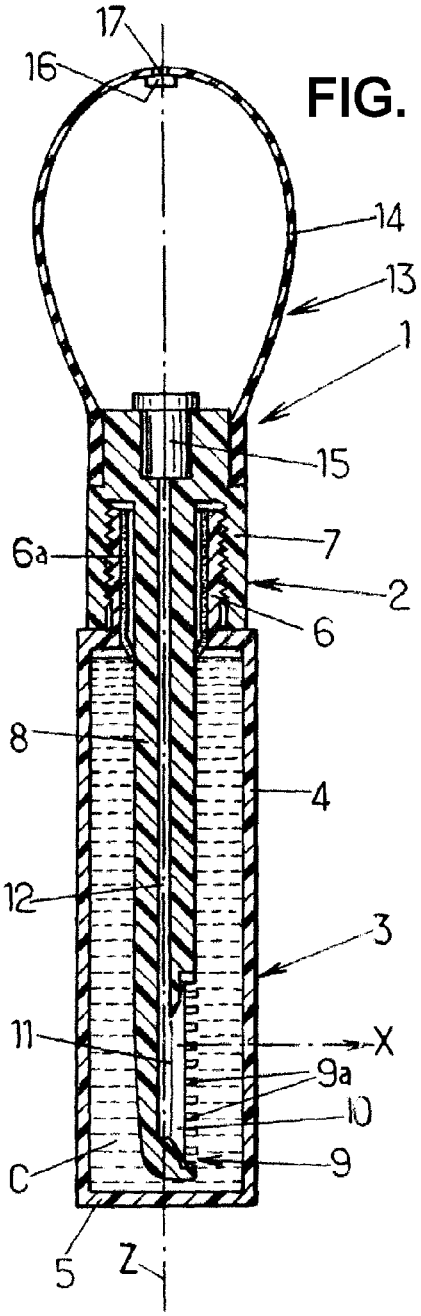
FIG. 1 is a longitudinal section view of a cosmetic applicator device in a first embodiment of the invention, in its storage position.

FIG. 1 shows an applicator device 1 for applying a liquid cosmetic that is viscous to a greater or lesser extent, in particular a mascara. The applicator device 1 comprises an applicator 2 that is made of plastics or other material, for example, and a reservoir 3 that is itself made of plastics or other material.

The reservoir 3 contains a mascara C that, by way of example, is considered throughout the description to be a liquid cosmetic. By way of example, said reservoir may include an annular side wall 4 that extends longitudinally between a bottom wall 5 and a neck 6 that is generally provided with an internal wiper 6*a* (shown very diagrammatically).

Figure 2:
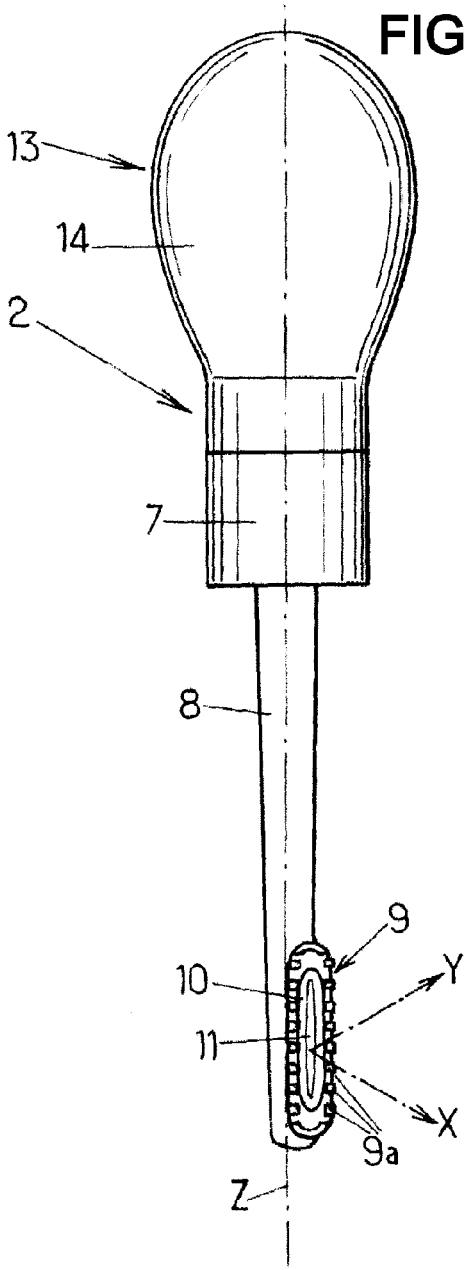
FIG. 2 is a perspective view of the applicator of the FIG. 1 device, removed from the reservoir.

Clearly visible in FIGS. 1 and 2, the applicator 2 includes a cap 7 that is adapted to close the neck 6, e.g. by screw-fastening or by some other means, and a stem 8 that extends along a longitudinal direction Z between the cap 7 and a free end that is provided with an applicator head 9 that may optionally be formed integrally with the stem 8.

The applicator head 9 may possibly be widened sideways relative to the stem 8.

By way of example, the applicator head 9 may include a dish 10 that is open along a normal direction X that is perpendicular to the longitudinal direction Z, the dish extending in a plane YZ, in which Y is a transverse direction that is perpendicular to the above-mentioned directions X and Z. The dish 10 may advantageously present an oblong shape that is elongate along the direction Z.

The applicator head 9 further includes a vent 11 that opens out into the bottom of the dish 10 along the axis X. In the embodiment under consideration, the vent 11 may be in the form of a slot that is parallel to the longitudinal direction Z.

In addition, and where appropriate, the applicator head 9 may be provided with teeth 9*a* that project along the normal direction X, and that surround the dish 10, or at the very least that are disposed on either side of the dish 10 in the transverse direction Y.

The above-mentioned vent 11 communicates with a duct 12 that is formed in the stem 8. In the embodiment shown, the duct 12 extends inside the stem 8 along the longitudinal direction Z, along the entire length of said stem 8 as far as the cap 7 where said duct communicates with a gas generator 13. In this embodiment, the gas generator 13 is secured to the cap 7 and is adapted to inject air into the duct 12.

In general, the gas generator may be of any known type: a manual pump (taking the form of a piston pump, a bellows, or a bulb); an electrically-controlled pump; a reservoir of compressed gas (air or other gas) associated with an outlet valve; etc.; the gas generator preferably being designed to inject a predetermined volume of gas into the duct 12 on each actuation by a user.

In particular, the gas generator 13 may be an air pump that comprises a variable-volume air chamber that communicates:

- with the duct 12 via an outlet valve 15 that enables air from the air chamber to be expelled towards the duct 12, but not the reverse; and
- with the atmosphere via an inlet valve 16 that enables air from the atmosphere to be let into the air chamber, but not the reverse.

The inlet and outlet valves 15, 16 may be of any type known to the person skilled in the art: a ball valve; a floating-diaphragm valve; a slot diaphragm; etc.

In the embodiment in FIGS. 1 and 2, the air pump comprises a flexible bulb 14 that is made of elastomer or the like, that is adapted to be squeezed by the user, and that defines the above-mentioned air chamber. The bulb may be fastened to the cap 7, and, from said cap, may extend away from the stem 8, as far as a trailing end that may present an opening 17 through which the inlet valve 16 may communicate with the atmosphere.

Figure 3:
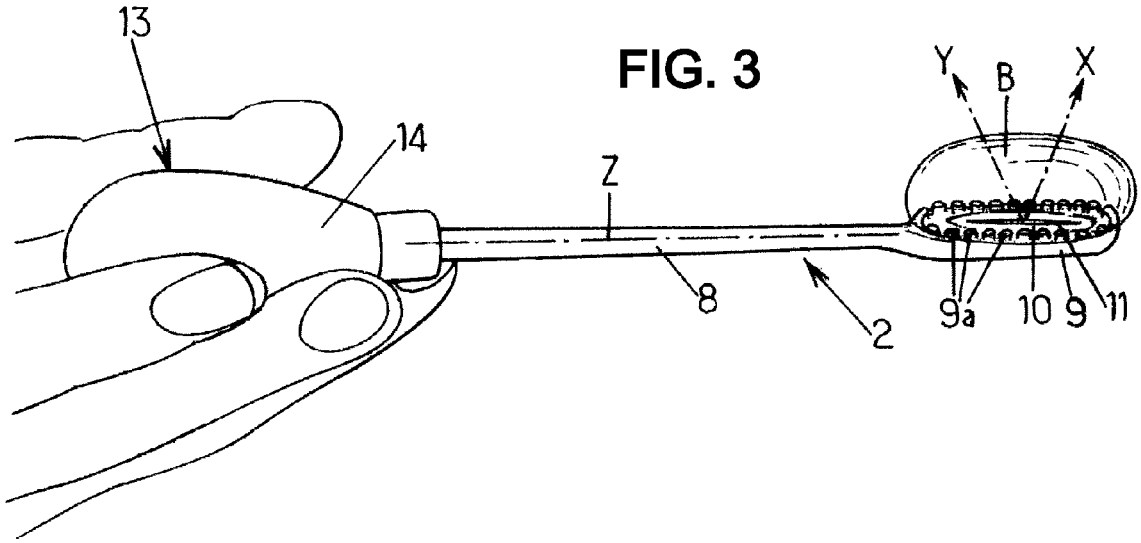
FIG. 3 is a perspective view of the FIG. 2 applicator, during use.

When a user removes the applicator 2 from the reservoir 3, the wiper 6*a* of the reservoir eliminates any excess mascara on the stem 8 and the applicator head 9 in manner known per se, but leaves a certain quantity of mascara behind in the dish 10. The user may thus squeeze manually on the bulb 14, as shown in FIG. 3, injecting a predetermined quantity of air into the air duct 12, the quantity of air leaving via the vent 11, forming a bubble B from the mascara stored essentially in the dish 10 at the applicator head 9. When the user puts the bubble B of mascara into contact with a part of the body, e.g. the eyelashes, the bubble bursts, instantly applying a film of mascara to the eyelashes, without the applicator head coming into contact with the eyelashes or the eyelids. The applicator head 9 may possibly then be used to perfect the distribution of the mascara applied in this way, in particular as a function of the shape of the applicator head 9, and in particular the shape of the above-mentioned teeth 9*a*.

In another variant of the invention, the applicator device 1 may include an applicator head 9 that is formed with a plurality of dishes 10, each dish 10 including at least one vent 11. In general, by means of such arrangements, it is possible to individualize the characteristics of each bubble that is formed, by changing the size of each dish (quantity of cosmetic), and the flowrate of each vent (diameter and number) for a given dish 10. A bubble will have a greater loading effect if it is small in size for a given region of the body. Where appropriate, the applicator head 9 may also be provided with teeth 9*a* on either side of each of the dishes 10, in the transverse direction Y. Thus, it is possible to choose to form bubbles that are all identical or that are all different, so as to adapt to the characteristics of the region of the body under consideration, and so as to adapt to the result desired for a given region of the body.

Figure 4:
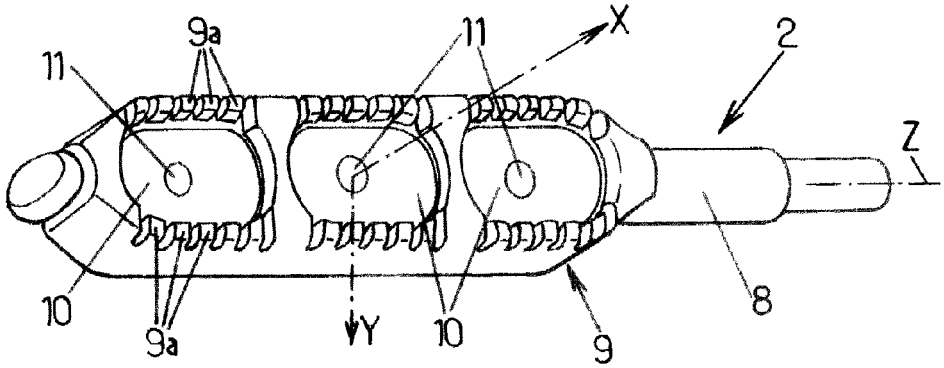
FIG. 4 is a perspective view of the applicator head of the applicator in a variant embodiment of the invention.

In this variant, the applicator device 1, shown in FIG. 4, is similar to the above-described device, except that the applicator head 9 is formed with three vents 11 that communicate with the duct 12 of the stem 8, each of the vents 11 opening out into the bottom of a respective dish 10, so that the applicator 2 can thus form three juxtaposed bubbles that then present the same characteristics, in each of the three dishes 10 respectively.

Figure 5:
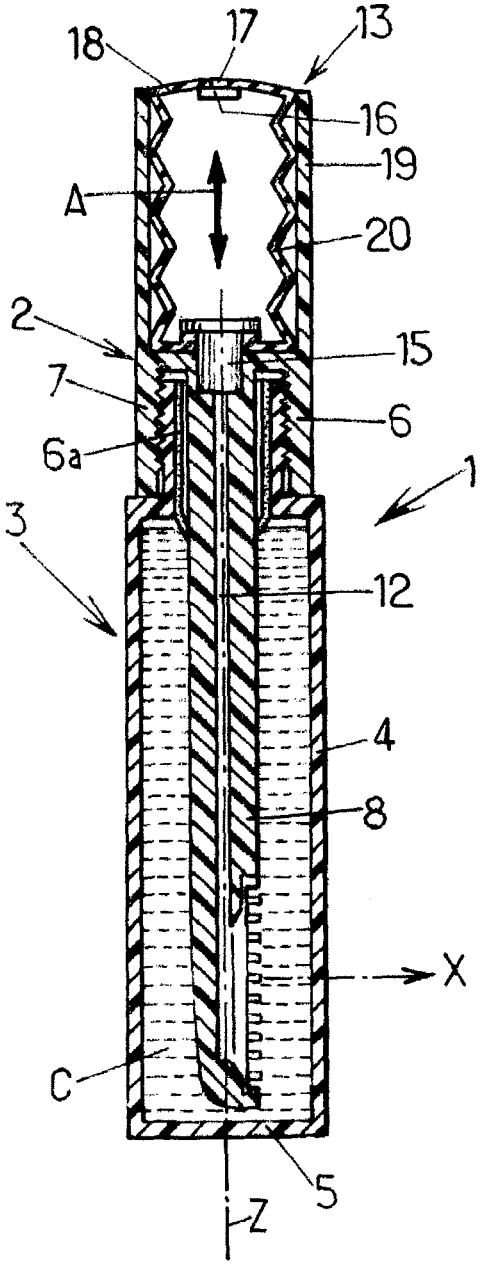
FIG. 5 is a view similar to the view in FIG. 1, in a second embodiment of the invention.

In the second embodiment of the invention, shown in FIG. 5, the applicator device 1 is also similar to the above-described device, and differs from the above-described device merely by the structure of the gas generator 13. In this embodiment, the gas generator is once again an air pump, but the air pump does not comprises a bulb 14, but rather a pusher 18 that slides in a cylindrical guide 19 that forms part of the cap 7 parallel to the direction Z, in the directions of the double-headed arrow A. The pusher 18 is secured to a bellows 20 that is made of elastomer, for example, and that defines the above-mentioned air chamber. The bellows 20 may be made of elastomer, for example, and, where appropriate, it may be made integrally with the pusher 18. The bellows 20 may be connected in airtight manner to the above-mentioned outlet valve 15, and the above-mentioned inlet valve 16 may be formed in the pusher 18, communicating with the atmosphere via an opening 17 that is formed in the pusher 18, the outlet valve 15 itself communicating, as above, with the duct 12 of the stem 8.

Figure 6:
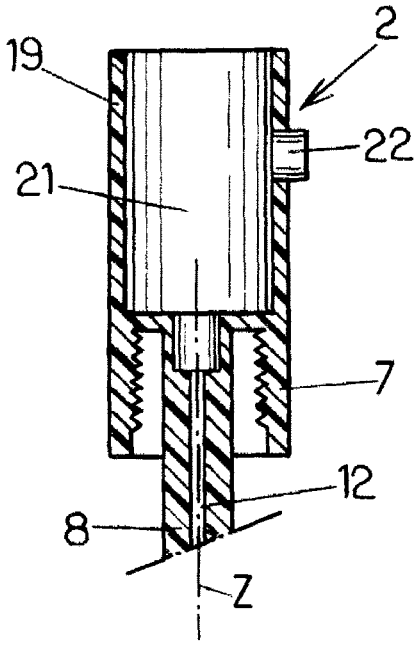
FIGS. 6 and 7 are longitudinal section views of the cap of the applicator, in third and fourth embodiments of the invention.
Figure 7:
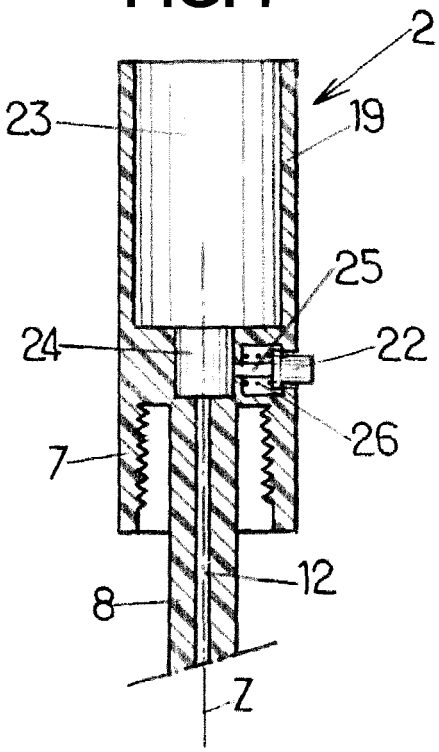

The third and fourth embodiments of the invention, shown in FIGS. 6 and 7, differ from the first two embodiments by their gas generators, which:

in the embodiment in FIG. 6, is an electric air compressor 21 of any known type (e.g. an air pump that is driven by a solenoid or other actuator) that is secured with the cap 7, e.g. by interfitting in a cylindrical wall 19 of the cap 7, the electric air compressor being actuatable by a user by means of a control button 22; and in the embodiment in FIG. 7, comprises a compressed-gas reservoir 23, e.g. containing compressed air, that communicates with the duct 12 by means of a valve 24, e.g. a metering valve. By way of example, the compressed-gas reservoir 23 may be mounted by interfitting in a cylindrical wall 19 that is secured to the cap 7, and, by way of example, the valve 24 may be controlled by a side button 22 that is mounted in the side of the cap 7, the side button 22 being secured to a rod 25 that is adapted to actuate the valve 24, and said cap being urged towards a rest position by a spring 26 or the like.

In these third and fourth embodiments, the volume of air that is injected into the duct 12 so as to form one or more bubbles may be adjusted more finely and in more reproducible manner. The predetermined volume of air that is injected into the duct 12 on each actuation of the gas generator may either be adjusted once when the applicator is designed, or it may be adjusted by the user by means of an adjustable knurled wheel (not shown) or by some other means.

It should also be observed that in all of the embodiments of the invention, the gas generator may either be mounted in permanent manner on the applicator, or it may be removable.

What is claimed is:

1. A method of applying a cosmetic with a device comprising a reservoir and an applicator, said reservoir containing a liquid cosmetic and said applicator comprising a stem that is terminated by an applicator head that is adapted to apply said cosmetic to a part of a user's body, said stem being adapted to penetrate into said reservoir so as to dip said applicator head into said cosmetic, said stem of the applicator including an internal duct that opens out sideways via at least one vent that is formed in the applicator head, and the applicator further comprising a gas generator that is connected to said duct and that is adapted to inject gas into said duct so as to cause the gas to be expelled via said at least one vent, said method comprising at least the following steps:

(a) dipping said applicator head into said cosmetic contained in the reservoir;

(b) actuating said gas generator for expelling gas via said at least one vent, thereby generating at least one bubble of cosmetic; and (c) bursting said at least one bubble on coming into contact with a region of the body so as to apply said cosmetic to said region.

2. The method according to claim 1, wherein the gas generator is actuatable by the user at step (b), the gas generator generates a predetermined volume of air upon actuation by the user.

3. The method according to claim 2, wherein the gas generator of the device which is used, includes an outlet valve that enables gas from the gas generator to be expelled towards the duct, but not the reverse.

4. The method according to claim 3, wherein the gas generator of the device which is used, is an air pump comprising a variable-volume air chamber that communicates with the duct via said outlet valve, and with the atmosphere via an inlet valve that enables air from the atmosphere to be let into the air chamber, but not the reverse.

5. The method according to claim 4, wherein the gas generator comprises a flexible bulb that defines said air chamber and at step (b), the user squeezes said flexible bulb.

6. The method according to claim 4, wherein the gas generator comprises a pusher that is actuatable by the user, that is adapted to compress the air chamber, and that is slidably mounted in a guide that forms part of the applicator, and at step (b), the user pushes said pusher.

7. The method according to claim 1, wherein the gas generator comprises an electric air compressor that is controlled by a control member and at step (b), the user actuates said control member.

8. The method according to claim 1, wherein the gas generator comprises a compressed-gas reservoir that is connected to the duct via a valve and at step (b), the user actuates said valve.

9. The method according to claim 1, wherein the applicator head of the device which is used, includes a dish that opens outwards and that forms a reservoir for the cosmetic, said dish surrounding said at least one vent that opens out into said dish.

10. The method according to claim 9, wherein the applicator head of the device which is used, includes a plurality of vents and a plurality of dishes that open outwards and that form reservoirs for the cosmetic, each dish surrounding at least one of said vents.

11. The method according to claim 1, wherein the applicator head of the device which is used, further includes teeth.

12. The method according to claim 11, wherein the applicator head of the device which is used, includes a dish that opens outwards and that forms a reservoir for the cosmetic, said dish surrounding said at least one vent that opens out into said dish, and wherein at least some of said teeth are disposed on either side of the dish.

13. The method according to claim 1, wherein the stem of the device which is used, extends longitudinally from said cap as far as the applicator head, and is adapted to penetrate into the reservoir when the cap closes said reservoir, the gas generator being mounted on the cap.

14. The method according to claim 1, wherein said liquid cosmetic is a mascara.

* * * * *